US006802819B1

(12) United States Patent
Liao

(10) Patent No.: US 6,802,819 B1
(45) Date of Patent: Oct. 12, 2004

(54) NOVELTY BAR OF SOAP HAVING LOW COST ELECTRO-MECHANICAL VIBRATING ASSEMBLY

(76) Inventor: Chu-Yuan Liao, 17F, No. 102, Section 2, Rossevelt Road, Taipei (TW)

( * ) Notice: Subject to any disclaimer, the term of this patent is extended or adjusted under 35 U.S.C. 154(b) by 0 days.

(21) Appl. No.: 10/621,664

(22) Filed: Jul. 18, 2003

(51) Int. Cl.[7] ..... A61H 1/00
(52) U.S. Cl. ..... 601/72; 252/92
(58) Field of Search ..... 601/72; 252/90, 252/92

(56) References Cited

U.S. PATENT DOCUMENTS 4,861,505 A 8/1989 Farman ..... 252/92
5,125,398 A 6/1992 Horton ..... 128/32

*Primary Examiner*—Michael A. Brown
(74) *Attorney, Agent, or Firm*—LaMorte & Associates, P.C.

(57) ABSTRACT

A novelty bar of soap containing an electro-mechanical vibrating mechanism. Within a housing is disposed an electric motor that rotates a weight from an eccentric point. Two reed switches are connected in parallel within the housing. Two alkaline batteries are also provided in the housing. The reed switches selectively power the electric motor with the batteries when at least one of the reed switches is closed. A body of soap surrounds the housing forming a bar of soap. Within the housing, one of the reed switches is disposed proximate the top of the housing. The other reed switch is disposed proximate the bottom of the housing. As such, regardless of how the bar of soap is oriented when placed down, one of the reed switches is positioned near the surface or which the bar of soap is resting.

10 Claims, 3 Drawing Sheets

NOVELTY BAR OF SOAP HAVING LOW COST ELECTRO-MECHANICAL VIBRATING ASSEMBLY

BACKGROUND OF THE INVENTION

1. Field of the Invention

The present invention relates to bars of soap that are used for bathing. More particularly, the present invention relates to bars of soap that have secondary functions and/or components traditionally not associated with soap.

2. Description of the Prior Art

Soap has been in existence in various forms for hundreds of years. One of the most popular forms of soap is that of a bar. A bar of soap is popular because it is easy to handle and manipulate while bathing. The bar of soap is traditionally made of pure soap and other water soluble ingredients. As such, the soap continues to function as soap until the bar is completely dissolved, thereby producing no waste product that must be thrown away.

Bars of soap have been manufactured in many different sizes and shapes. Over the years, novelty bars of soaps have been molded into many secondary items, such as flowers, seashells, animals and the like. However, regardless of what form the soap is molded into, the bar of soap is almost always made of totally dissolvable ingredients. As such, when the soap is used, the configuration of the bar of soap erodes away until nothing is left.

There are some instances in the prior art where electronic assemblies have been added to bars of soap. In such prior art products, an electronics module is placed in the center of the soap and the soap is used until the electronics module is exposed. One such prior art device. is shown in U.S. Pat. No. 5,125,398 to Horton, entitled Personal Hygienic Massage Bar. In the Horton patent, a vibrating device is positioned in the soap. However, whenever electronics are added to soap, there must be included some way to selectively activate the electronics within the soap after the soap is purchased.

In the cited Horton patent, a slot is provided in the soap near the battery. A plastic tab is placed in the slot and prevents the battery from making electrical contact within the soap. Once the soap is purchased, the tab is removed and the battery is activated. To prevent the vibrating mechanism from running all the time, a motion sensor and a timing circuit are provided that automatically shuts the vibrating mechanism off after a predetermined period of time.

There are many disadvantages to providing such electronics within a bar of soap. First, the use of a slot in the bar of soap for a plastic pull tab, provides an opening through which water can travel into the electronics module within the soap. Once the electronics are exposed to water, the electronics short out and the electronics module within the soap stops working.

Second, even if water does not get into the electronics assembly, within the soap, the use of motion sensors and timing circuits makes the electronics assembly large, complicated and expensive to manufacture. The larger the electronics module is, the more room the electronics module takes within the soap. This is especially true with a vibrating mechanism, which tends to be large. As can be seen from the Horton patent, the vibrating mechanism takes up most of the volume of the bar of soap. Accordingly, after only a very short period of use, the vibrating mechanism within the bar of soap can become exposed.

A third disadvantage of the vibrating mechanism used in the Horton patent is that the vibrating mechanism requires a large supply of electrical power. Vibrating mechanisms contain motors. Motors require electricity to operate. However, in the prior art, since the vibration mechanism itself tends to be large, small batteries are used to preserve space. Small specialty batteries, such as lithium and nickel-cadmium batteries are typically used since these are the only small batteries that can meet the power requirements of the vibrating mechanism. Such batteries are smaller than alkaline batteries, but are far more expensive. As such, by using small specialty, batteries, the price of the vibrating mechanism is greatly increased. Soap is a disposable item that lasts only a Short period of time. As such, the electronics within the soap must be able to outlast the soap, yet be inexpensive enough not to add significantly to the cost of the soap.

Simplified electronic assemblies have been added to soap in an attempt to limit the disadvantages stated above. For example in U.S. Pat. No. 4,861,505 to Farman, a sound producing assembly is provided in a bar of soap that is activated when the bar of soap is removed from a magnetic soap dish. Although such assemblies eliminate the need for pull tab openings and timing circuits, such prior art assemblies only work when the soap is oriented in a proper way with respect to the soap dish. If the soap is placed in the soap dish upside down or backward, the electronics assembly within the soap is not deactivated. In the Farman patent, the proper orientation of the soap is maintained by referencing an insignia formed in the soap. However, as is well known, the insignia on a bar of soap soon washes away. Once it does, the bar of soap can easily be misplaced and continue to operate unattended until the battery runs out.

A need therefore exists for a bar of soap that contains an electronic assembly, where the electronic assembly is water proof, very inexpensive, small, long lasting, uses conventional batteries and can be easily deactivated when not in use. This need is met by the present invention as is described and claimed below.

SUMMARY OF THE INVENTION

The present invention is a novelty bar of soap. The bar of soap has an external layer of soap, and therefore functions as a bar of soap. However, contained within the bar of soap is an electro-mechanical vibrating mechanism. The electro-mechanical vibrating mechanism is contained in a water tight housing that is set into the center of the bar of soap. Within the housing is disposed an electric motor. The electric motor rotates a weight from an eccentric point, thereby causing vibration. Two reed switches are connected in parallel within said housing. Two alkaline batteries are also provided in the housing, where the reed switches selectively power the electric motor with the batteries when at least one of the reed switches is closed. A body of soap surrounds the housing forming a bar of soap.

Within the housing, one of the reed switches is disposed proximate the top of the housing. Similarly, the other reed switch is disposed proximate the bottom of the housing. As such, regardless of how the bar of soap is oriented when placed down, one of the reed switches is positioned near the surface on which the bar of soap is resting. By providing a magnet on such a resting surface, the vibrating mechanism can be selectively deactivated every time it is placed down on the resting surface without regard for the orientation of the bar of soap.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
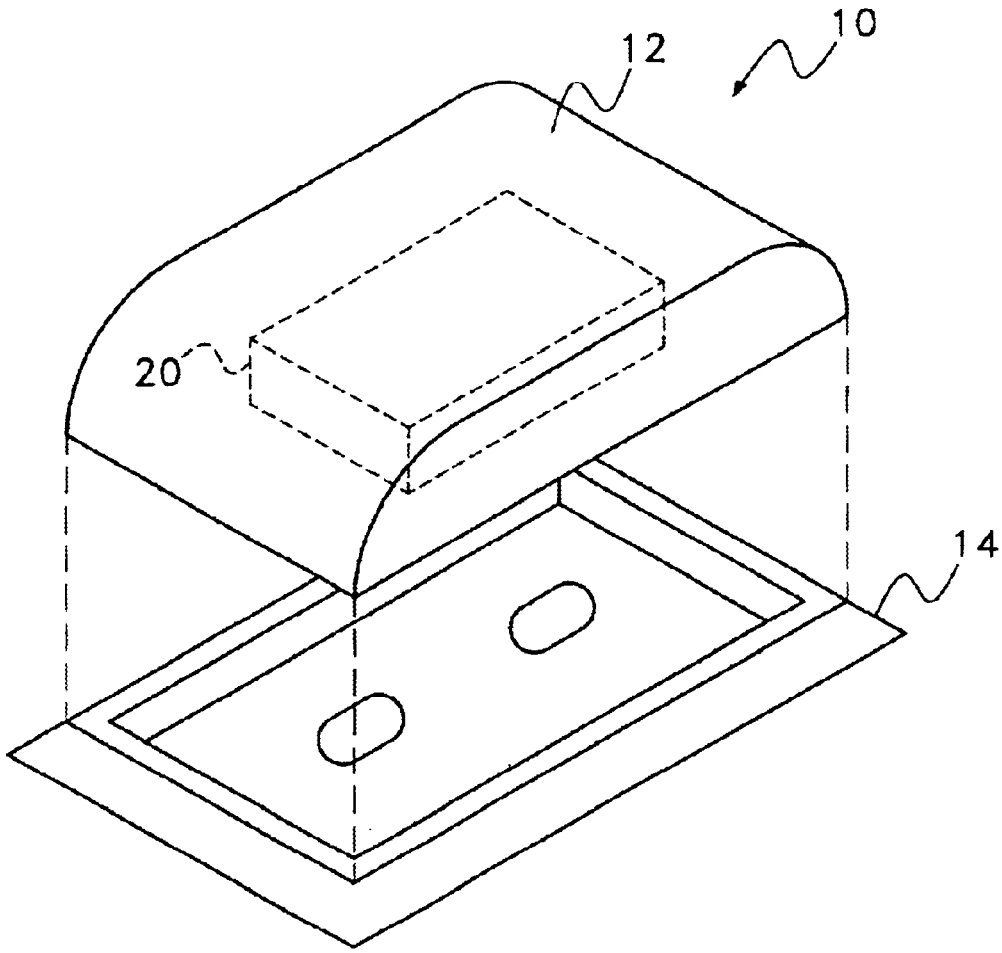
FIG. 1 is a perspective view of an exemplary embodiment of the present invention.

Referring to FIG. 1, an exemplary embodiment of the present invention novelty soap assembly 10 is shown. In this embodiment, there is contained a bar of soap 12 of a traditional shape and size. The bar of soap 12 is provided with a soap dish 14 that is sized to receive and retain the bar of soap 12. When the bar of soap 12 is lifted out of the soap dish 14, the bar of soap 12 will begin to vibrate due to the activation of a small electro-mechanical vibrating mechanism 20 contained within the center of the bar of soap 12. The electro-mechanical vibrating mechanism 20 is very compact and inexpensive. Furthermore, the electro-mechanical vibrating mechanism 20 is powered by low cost AAA alkaline batteries. As such, the overall electro-mechanical vibrating mechanism 20 can be made at a very low cost and can be made to operate for many hours. The electro-mechanical vibrating mechanism 20 will therefore last for the life of the bar of soap 12 during normal use conditions.

Figure 2:
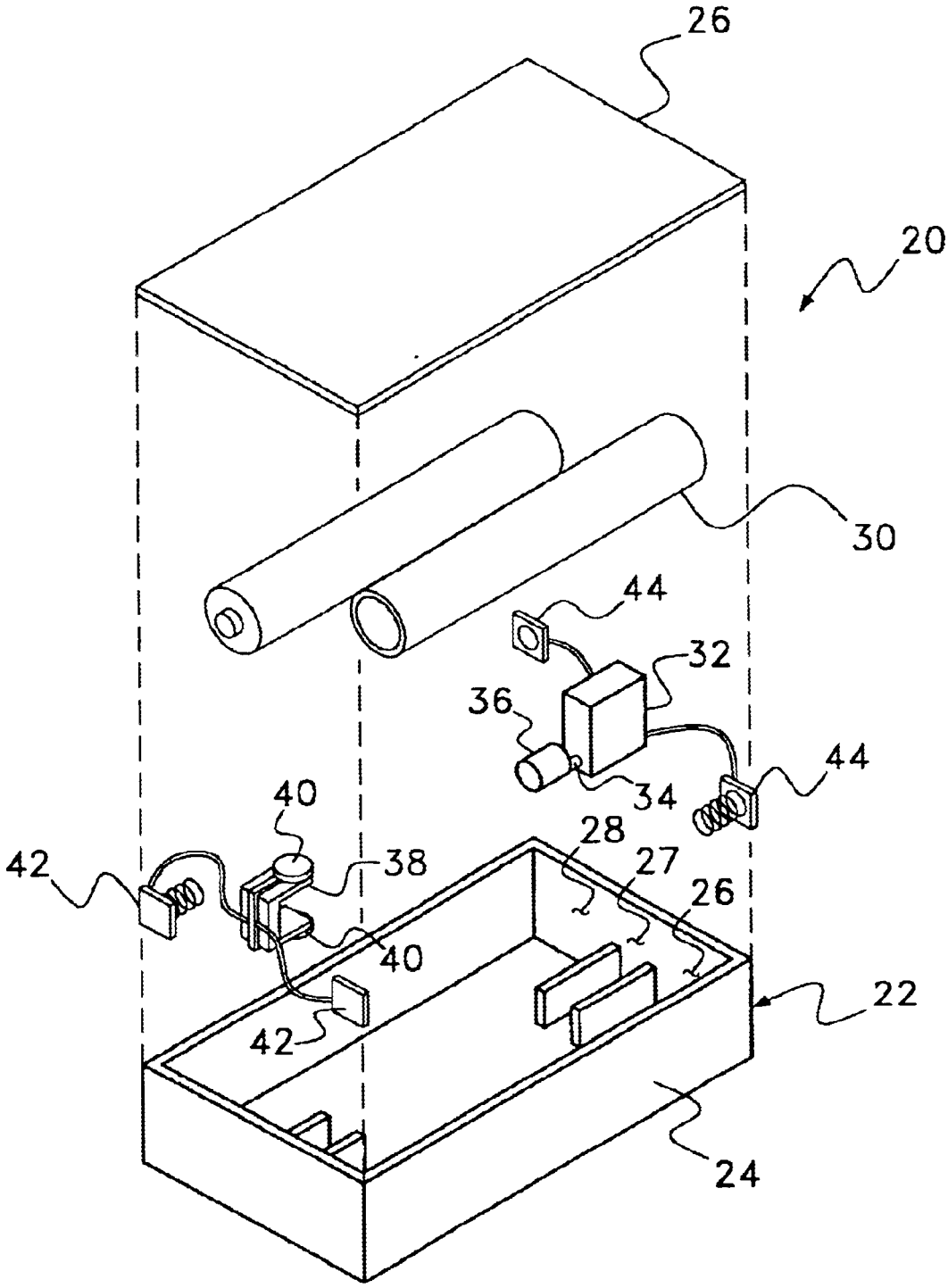
FIG. 2 is an exploded view of the electro-mechanical vibrating mechanism used within a bar of soap.

Referring to FIG. 2, the configuration of the electro-mechanical vibrating mechanism 20 is shown. The electro-mechanical vibrating mechanism 20 has a housing 22. The housing 22 has a height of about one and a half centimeters, which is just taller than the diameter of a standard AAA alkaline battery. The length of the housing 22 is approximately five and a half centimeters, which is just longer than the length of a standard AAA alkaline battery. Lastly, the housing 22 has a width of approximately four and a half centimeters, which is about three times the diameter of a standard AAA alkaline battery.

The housing 22 consists of a base 24 and a lid 26. The base 24 and the lid 26 are sealed together with adhesive, therein the lid 26 and the base 24 of the housing 22 make a watertight seal, thereby isolation the interior of the housing 22.

From FIG. 2, it can be seen that the base 24 of the housing 22 is divided into three sections 26, 27, 28. The two side sections 26, 28 are shaped to receive a standard AAA alkaline battery 30. The center section 27 of the housing 22 receives a small electric motor 32 that is generally the same width as the AAA alkaline battery. The electric motor 32 has a shaft 34 that is eccentrically coupled to a weight 36. The weight 36 is therefore rotated by the electric motor 32 in between the two AAA alkaline batteries 30.

Also positioned within the center-section 27 of the housing base 24 is a U-shaped support element 38. Two reed switches 40 are coupled to opposite arms of the U-shaped support element 38. One arm of the U-shaped support element 38 supports one of the reed switches 40 near the floor of the housing base 24. The opposite arm of the U-shaped support element 38 holds a second reed switch 40 adjacent the lid 26 of the housing 22.

The two reed switches 40 are wired together in parallel. The two reed switches 40 are also wired to contacts 42 for the AAA alkaline batteries 30. As such, the reed switches 40, the electric motor 32 and the rotating weight 36 are all disposed in the central section 27 of the housing base 24 in between the two AAA alkaline batteries.

The reed switches 40 connect to the AAA alkaline batteries 30 on one side of the housing 22 via a set of battery contacts 42. On the opposite side of the AAA alkaline batteries 30, the electric motor 32 is also wired to contacts 44 for the batteries 30. Accordingly, when either of the reed switches 40 is activated, a circuit is completed between the two AAA alkaline batteries, 30 and the electric motor 32. The electric motor 32 will then rotate the weight 36 in between the AAA alkaline batteries 30 and the overall electro-mechanical vibrating mechanism 20 will vibrate.

Since the electric motor 32 is powered by two AAA alkaline batteries 30, the electric motor 32 can operate on and off for the better part of a few hours before the batteries are drained. The duration of the operational time is dependent upon the quality of the batteries. At a minimum, the sum total of operational time of the vibrating mechanism 20 should be at least one hour.

Figure 3:
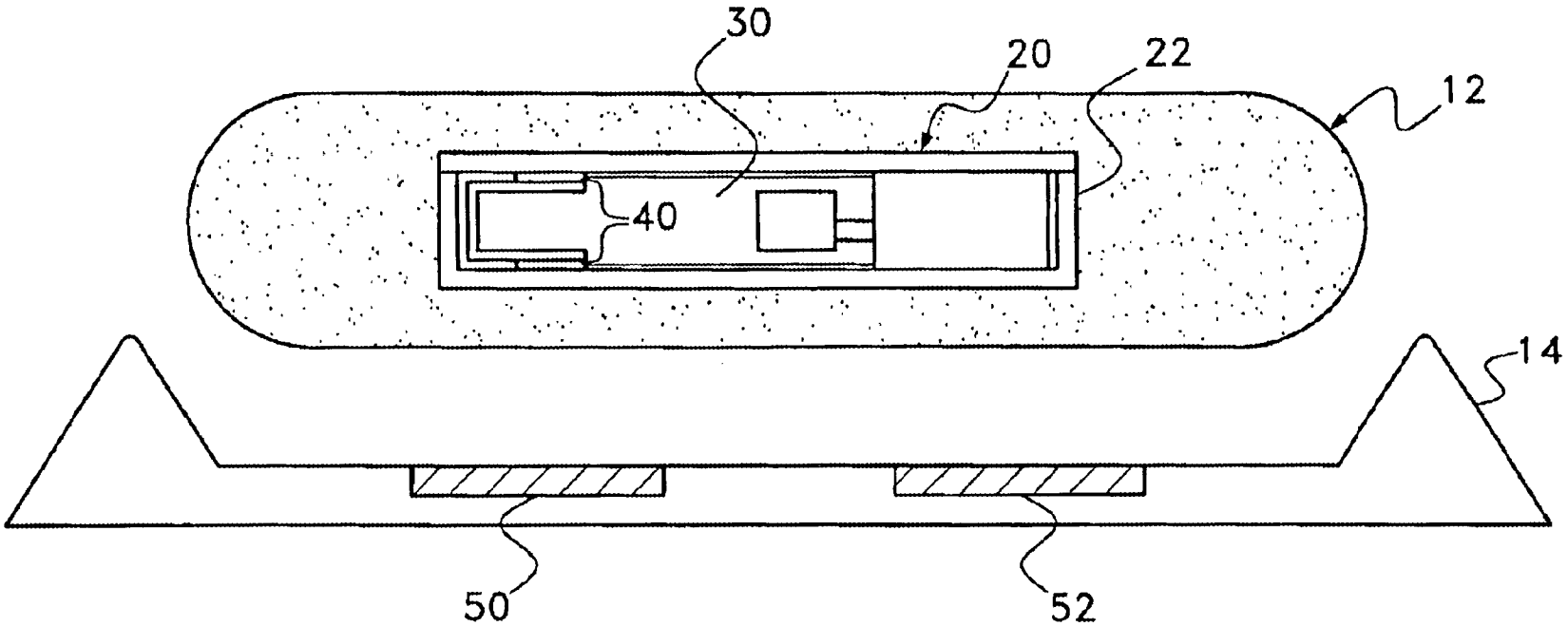
FIG. 3 is a cross-sectional view of the bar of soap resting in a soap dish.

Referring to FIG. 3, it can be seen that the housing 22 of the electro-mechanical vibrating mechanism 20 is positioned in the center of the bar of soap 12. However, do to the slim configuration of the housing 22, there still exists at least one full centimeter of soap. material around all surfaces of the electro-mechanical vibrating mechanism 20. This can be done while keeping the bar of soap 12 to traditional dimensions. By providing at least one centimeter of soap around all surfaces of the electro-mechanical vibrating mechanism 20, the bar of soap 12 will last through dozens of washings before the housing 22 of the electro-mechanical vibrating mechanism 20 becomes exposed.

As can also be seen from FIG. 3, a soap dish 14 is provided for holding the bar of soap 12 when the bar of soap 12 is not being used for washing. Within the soap dish 14 are disposed two magnets 50, 52. The first magnet 50 is positioned near the rear of the soap dish 14 and the second magnet 52 is positioned near the front of the soap dish 14. When the bar of soap 12 is placed in the soap dish 14, one of the reed switches 40 within the electro-mechanical vibrating mechanism 20 comes into close proximity with one of the magnets 50, 52. The determination of which reed switch 40 comes into close proximity with which of the magnets 50, 52 is determined purely by chance, depending upon how the bar of soap 12 is oriented when placed in the soap dish 14. However, regardless of how the bar of soap 12 is placed in the soap dish 14, one of the reed switches 40 will always be affected by one of the magnets 50, 52.

The reed switches 40 used in the electro-magnetic vibrating assembly 20 are normally closed switches. However, when in the magnetic field of one of the magnets 50, 52, the reed switches 40 open. When one of the reed switches 40 opens, the reed switch 40 opens the circuit that drives the electric motor 32. As such, when the bar of soap 12 is placed in the soap dish 14, the electric motor 32 is deactivated and the bar of soap 12 will not vibrate. However, as soon as the bar of soap 12 is removed from the soap dish 14, the reed switch 40 again closes, the electric motor 32 spins and the bar of soap 12 vibrates.

With the exception of wiring and molded plastic, the electro-mechanical vibrating mechanism 20 contains only two AAA alkaline batteries 30 (FIG. 2), two reed switches 40, a small electric motor 32 and a weight 36 (FIG. 2). All such components are commercially available off-the-shelf at very low cost. Furthermore, by providing the two AAA batteries 30, a long lasting source of power is provided that lasts far longer and is far less expensive than specialty nickel cadmium batteries or lithium batteries. Furthermore, by providing a housing 22 that is barely larger than the batteries, a vibrating mechanism can be provided in a bar of soap 12 that takes up less than half the volume of the bar of soap 12. The bar of soap 12 can, therefore, be used at least fifty percent as long as a tradition solid bar of soap.

It will be understood that the embodiments of the present invention described and illustrated herein are merely exemplary and a person skilled in the art can make many variations to the embodiments shown without departing from the scope of the present invention. All such variations, modifications and alternate embodiments are intended to be included within the scope of the present invention as defined by the appended claims.

What is claimed is:

1. A novelty assembly, comprising:

a housing;

an electric motor within said housing;

a weight rotated from an eccentric point by said electric motor within said housing;

two reed switches connected in parallel within said housing;

two alkaline batteries, wherein said batteries are wired to said reed switches within said housing and power said electric motor when at least one of said reed switches is activated;

a body of soap surrounding said housing forming a bar of soap.

2. The assembly according to claim 1, wherein said housing retains said two alkaline batteries in a parallel orientation within said housing, wherein a space exists between said two alkaline batteries within said housing.

3. The assembly according to claim 2, wherein said electric motor and said weight and said reed switches are disposed in said space between said two alkaline batteries within said housing.

4. The assembly according to claim 3, wherein each of said two alkaline batteries has a predetermined length and said space between said two alkaline batteries is no longer than said predetermined length.

5. The assembly according to claim 1, wherein said housing has a top surface,and a bottom surface, and wherein one of said reed switches is disposed within said housing proximate said top surface and one of said reed switches is disposed within said housing proximate said bottom surface.

6. The assembly according to claim 1, further including a soap dish for holding said bar of soap, said soap dish containing at least one magnet that opens at least one of said reed switches in said bar of soap when said bar of soap is placed in said soap dish.

7. The assembly according to claim 6, wherein said bar of soap is positionable in said soap dish in multiple orientations, and wherein said soap dish contains multiple magnets for opening at least one of said reed switches when said bar of soap is placed in said soap dish in any of said multiple orientations.

8. The assembly according to claim 1, wherein said housing has a fist volume and said bar of soap has a second volume, wherein said first volume of said housing is less than half of said second volume of said bar of soap.

9. A method of manufacturing a bar of soap that vibrates, said method comprising the steps of:

providing a vibrating motor;

providing at least one battery;

providing two reed switches that are connected in parallel, wherein said reed switches interconnect said at least one battery to said vibrating motor when at least one of said reed switches is closed;

providing a water tight housing having a top surface and an opposite bottom surface;

placing said vibrating motor, said at least one battery, and said reed switches in said housing, wherein one of said reed switches is disposed proximate said top surface of said housing and one of said reed switches is disposed proximate said bottom surface of said housing; and encapsulating said housing within a volume of soap.

10. The method according to claim 9, further including the step of providing a soap dish having magnets disposed therein.

* * * * *